US005904128A

United States Patent [19]

Shimada et al.

[11] Patent Number: 5,904,128

[45] Date of Patent: May 18, 1999

[54] CYLINDER FUEL INJECTION ENGINE CONTROLLER

[75] Inventors: Kousaku Shimada, Hitachinaka; Kouji Hosokawa, Higashimurayama; Takeshi Atago, Hitachinaka, all of Japan

[73] Assignee: Hitachi, Ltd., Japan

[21] Appl. No.: 09/016,310

[22] Filed: Jan. 30, 1998

[30] Foreign Application Priority Data

Jan. 31, 1997 [JP] Japan ..... 9-019026

[51] Int. Cl.[6] ..... F02D 41/16

[52] U.S. Cl. ..... 123/339.12; 123/339.16; 123/339.24; 123/295

[58] Field of Search ..... 123/339.12, 339.16, 123/339.17, 339.18, 339.24, 295

[56] References Cited

U.S. PATENT DOCUMENTS

| | | | |
|---|---|---|---|
| 4,721,082 | 1/1988 | Hibino et al. | 123/339.12 |
| 5,628,290 | 5/1997 | Iida et al. | 123/339.12 |

FOREIGN PATENT DOCUMENTS

| | | | |
|---|---|---|---|
| 4-86353 | 3/1992 | Japan | 123/339.12 |
| 5-10179 | 1/1993 | Japan | 123/339.12 |

*Primary Examiner*—Erick R. Solis

*Attorney, Agent, or Firm*—Evenson, McKeown, Edwards & Lenahan, P.L.L.C.

[57] ABSTRACT

A cylinder fuel injection engine controller for controlling a cylinder fuel injection engine is capable of controlling the cylinder fuel injection engine for operation at a stable idling speed regardless of the variation of engine speed and load on the cylinder fuel injection engine while the cylinder fuel injection engine is cold and stratified combustion is impossible. The cylinder fuel injection engine controller comprises: a basic fuel injection quantity determining means for determining a basic fuel injection quantity (Tp1), a reference fuel injection quantity determining means for determining a reference fuel injection quantity (Tp2) from an engine speed and an accelerator pedal position; and a target fuel injection quantity calculating means for determining a target fuel injection quantity (Tp3) by multiplying the reference fuel injection quantity (Tp2) by a desired A/F ratio and dividing the product of the multiplication by the stoichiometric A/F ratio. The cylinder fuel injection engine controller is characterized by a reference fuel injection quantity adjusting means for adjusting the reference fuel injection quantity (Tp2) for engine speed control and/or load correction during idling operation. Fuel injection quantity (Tp) to be supplied to the engine and intake air quantity (Q) are controlled simultaneously and separately on the basis of the reference fuel injection quantity (Tp2).

17 Claims, 15 Drawing Sheets

REFERENCE FUEL INJECTION QUANTITY TABLE Tp2

| Acc (deg) | ··· | 4 | 8 | ··· |
|---|---|---|---|---|
| Tp2 (ms) | ··· | 2.31 | 2.52 | ··· |

CYLINDER FUEL INJECTION ENGINE CONTROLLER

BACKGROUND OF THE INVENTION

The present invention relates to a cylinder fuel injection engine controller for controlling the operation of an engine in which fuel is injected directly into the cylinders and, more particularly, to a cylinder fuel injection engine controller capable of enabling an electronic engine control system to achieve an idling speed control operation and a load correcting control operation in satisfactory response.

A prior art cylinder fuel injection engine disclosed in, for example, JP-A No. 7-166916 proposes a technique relating to the control of change between an idling operation in which a rich fuel mixture produced around an ignition plug is ignited and flame propagates for stratified combustion, and a working operation. The prior art technique fully closes an idling bypass valve and a bypass passage if the opening of a throttle valve is greater than an idling opening during the operation of the cylinder fuel injection engine, and controls fuel injection quantity and fuel injection timing according to load on the engine so that stratified combustion occurs when load on the engine is in a low and medium load range and uniform combustion occurs when load on the engine in a high load range.

When the opening of the throttle valve is equal to an opening for idling operation, the idling bypass valve and the bypass passage are fully opened to secure an intake air flow and a volumetric efficiency corresponding to those for full-throttle operation, so that pump loss is reduced and engine speed tends to increase. Therefore, the quantity of fuel injected by an injector is reduced for correction to suppress the increase of engine speed. Thus, the prior art technique increases intake air quantity when it is decided that the mode of operation of the engine changed from a working operation mode to an idling mode to reduce pumping loss and to decrease fuel injection quantity accordingly.

Although the prior art technique concerns the control of intake air quantity and fuel injection quantity when the operating mode of the engine changes between an idling operation mode and a working operation mode, the same concerns nothing about the control of the variation of engine speed due to the variation of the temperature of engine cooling water during idling operation and the control of corrective operations to deal with disturbance such as the application of additional load, such as an air condition system, to the engine. Therefore, the prior art technique is unable to achieve the accurate control of intake air quantity and fuel injection quantity to deal with the variation of engine speed and load on the engine.

Since only stratified combustion is expected for idling operation, nothing is taken into consideration about the control of idling operation using a stoichiometric fuel mixture.

Accordingly, while the engine is cold and stratified combustion cannot be achieved or during stratified combustion after the engine has been warmed up, it is difficult to maintain an idling speed stably if engine speed varies or an additional load is applied to the engine.

SUMMARY OF THE INVENTION

The present invention has been made in view of the foregoing problems in the prior art and it is therefore an object of the present invention to provide a cylinder fuel injection engine controller capable of controlling an engine for stable operation at an idling speed regardless of the variation of engine speed or application of an additional load to the engine in a state where the engine is cold and stratified combustion is impossible or a state where the engine is warmed up and stratified combustion is possible.

According to the present invention, a cylinder fuel injection engine controller for controlling the operation of a cylinder fuel injection engine comprises an intake air quantity measuring means for measuring the quantity of air taken into a cylinder of the engine, an engine speed measuring means, an accelerator pedal position measuring means, a basic fuel injection quantity determining means for determining a basic fuel injection quantity Tp1 for each cylinder by dividing an intake air quantity by an engine speed and multiplying the quotient of the division by a coefficient which makes air-to-fuel ratio (A/F ratio) equal to the stoichiometric A/F ratio (=14.7), a reference fuel injection quantity determining means for determining a reference fuel injection quantity Tp2 from an engine speed and an accelerator pedal position, a target fuel injection quantity calculating means for determining a target fuel injection quantity Tp3 by multiplying the reference fuel injection quantity Tp2 by a desired A/F ratio and dividing the product of the multiplication by the stoichiometric A/F ratio (=14.7), and a reference fuel injection quantity adjusting means for adjusting the reference fuel injection quantity Tp2 for engine speed control and/or load correction during idling operation.

More specifically, the reference fuel injection quantity adjusting means for adjusting the reference fuel injection quantity Tp2 comprises a target engine speed setting means for setting a target engine speed on the basis of the temperature of engine cooling water and the condition of engine load switches for controlling loads on the engine, and an idling speed control means which calculates a change in the reference fuel injection quantity Tp2 on the basis of the target engine speed and an actual engine speed. The reference fuel injection quantity Tp2 is increased if the actual engine speed is lower than the target engine speed, and the reference fuel injection quantity Tp2 is decreased if the actual engine speed is higher than the target engine speed.

The reference fuel injection quantity adjusting means for adjusting the reference fuel injection quantity Tp2 increases the reference fuel injection quantity Tp2 by a predetermined quantity upon the detection of the closing of the engine load switch for controlling the load on the engine. The engine load switches are an air conditioning system control switch for controlling an air conditioning system, a power steering system control switch for controlling a power steering system, electric device control switches for controlling electric devices, and an electric radiator fan control switch for controlling an electric radiator fan. When one or some of the engine load control switches are closed, the reference fuel injection quantity Tp2 is increased by a predetermined quantity, and the target engine speed is increased by a predetermined value.

The cylinder fuel injection engine controller controls fuel injection quantity Tp and intake air quantity Q simultaneously and separately on the basis of the reference fuel injection quantity Tp2.

The cylinder fuel injection engine controller further comprises an intake air quantity feedback control means for controlling in a feedback control mode intake air quantity which makes the basic fuel injection quantity Tp1 vary according to the target fuel injection quantity Tp3, and a control parameter retrieving means for retrieving control parameters for determining an optimum ignition timing, an optimum A/F ratio, an optimum fuel injection timing and an optimum EGR ratio according to the operating condition of the engine from maps of engine speed and engine load.

The cylinder fuel injection engine controller sets a target engine speed on the basis of the temperature of engine cooling water or a change in the engine load during idling operation in which the temperature of engine cooling water is low or when load on the engine is varied by closing the engine load control switch, and calculates a change to be made in the reference fuel injection quantity Tp2 on the basis of the target engine speed and actual engine speed to increase or decrease the reference fuel injection quantity Tp2. Thus, an optimum reference fuel injection quantity Tp2 can be determined regardless of the variation of the load, and fuel injection quantity Tp and intake air quantity Q to be supplied to the engine are controlled simultaneously and separately on the basis of the optimum reference fuel injection quantity Tp2. Therefore, engine speed can be controlled in a high response speed, and the variation of engine speed due to change in the load can be suppressed to stabilize engine speed.

DETAILED DESCRIPTION OF THE PREFERRED EMBODIMENTS

Figure 1:
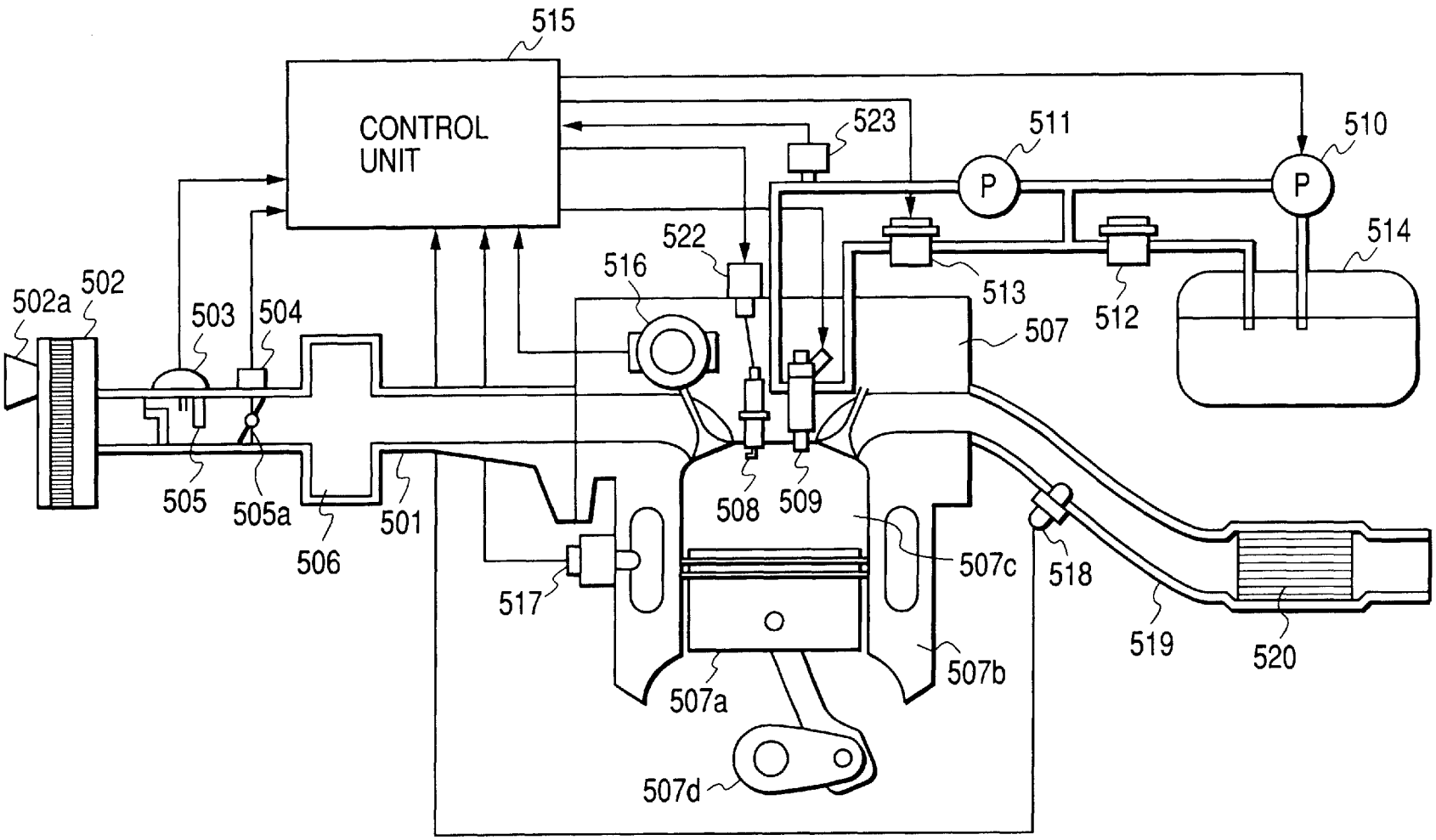
FIG. 1 is a typical view of a cylinder fuel injection engine system to be controlled by a cylinder fuel injection engine controller in a preferred embodiment according to the present inventions.

A cylinder fuel injection engine controller in a preferred embodiment according to the present invention will be described with reference to the accompanying drawings. Referring to FIG. 1 showing a control system for controlling an engine 507, intake air to be supplied to the engine 507 is taken into an air cleaner 502 through an inlet 502*a* and flows through an air flow sensor 503 and a throttle body 505 internally provided with a throttle valve 505*a* into a collector 506. Intake air is distributed from the collector 506 to the suction pipes 501 of a manifold connected to the cylinders 507*b* of the engine 507 to supply intake air to the combustion chambers 507*c* of the cylinders 507*b*.

Fuel, such as gasoline, is pumped up by a fuel pump 510 from a fuel tank 514 at a primary pressure, such as 3 kg/cm$^2$, for primary pressurization the fuel is pumped by a fuel pump 511 at a secondary pressure, such as 30 kg/cm$^2$, for secondary pressurization, and the fuel is supplied to a fuel feed system connected to fuel injectors 509. A fuel pressure regulator 512 regulates the primary pressure of the fuel, and a fuel pressure regulator 513 regulates the secondary pressure of the fuel. The fuel is injected into the cylinder 507*b* by the injector 509 combined with the cylinder 507*b*. An ignition coil 522 applies a high voltage to an ignition plug 508 to ignite the fuel injected into the cylinder 507*b*.

The air flow sensor 503 gives an air flow signal indicating an intake air flow to a control unit 515.

A throttle sensor 504 for measuring the opening of the throttle valve 505*a* is combined with the throttle body 505. The throttle sensor 504 gives a throttle opening signal indicating an opening of the throttle valve 505*a* to the control unit 515.

A crank angle sensor 516 combined with a camshaft, not shown, gives a reference angle signal REF indicating an angular position of a crankshaft 507*d* and an angle signal POS for determining engine speed to the control unit 515.

An A/F sensor 518 disposed in an exhaust pipe 519 at a position on the upstream side of a catalyst 520 detects the exhaust gas and gives an exhaust gas detection signal to the control unit 515.

Figure 2:
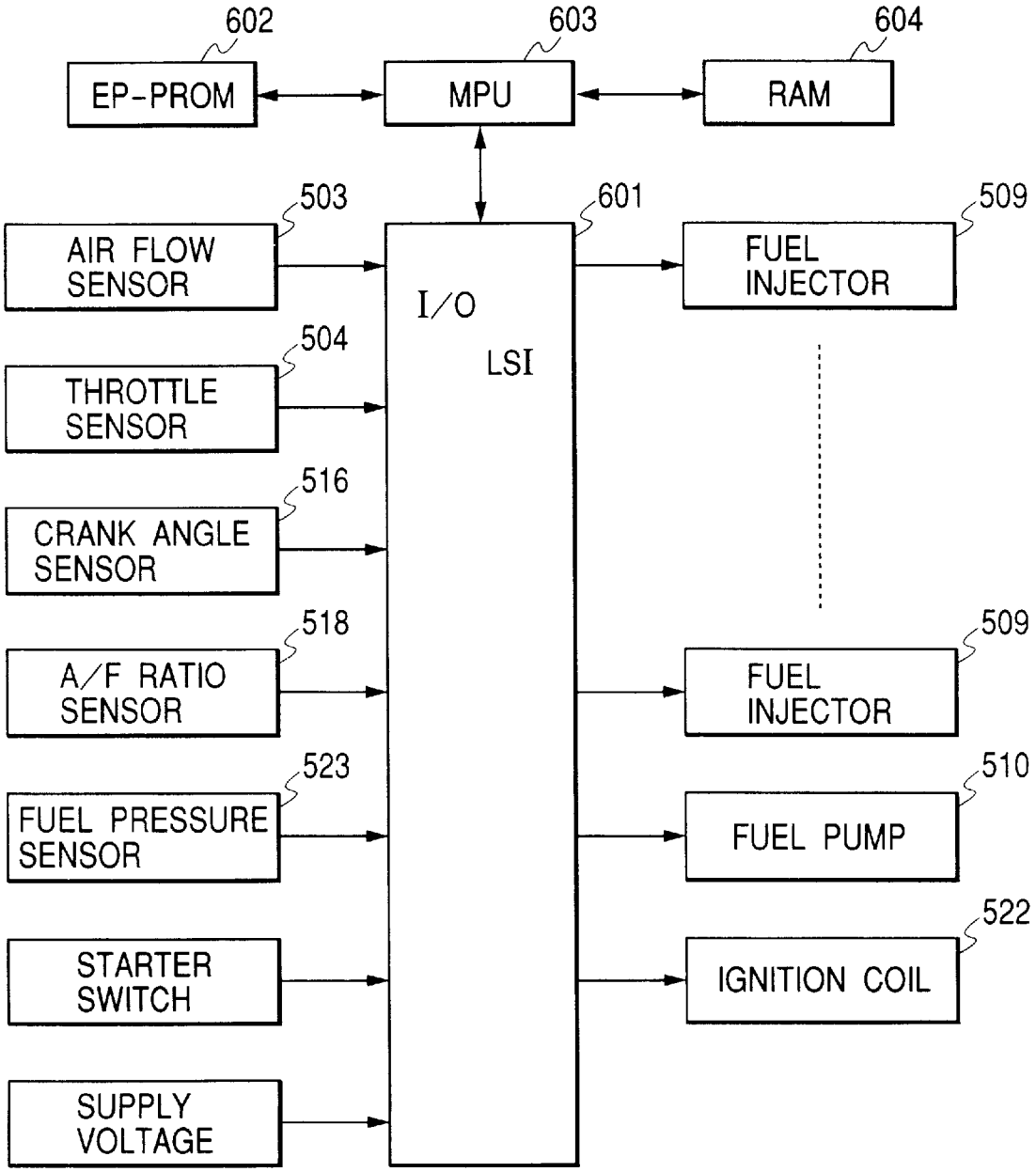
FIG. 2 is a block diagram of the cylinder fuel injection engine controller for controlling the cylinder fuel injection engine system of FIG. 1.

As shown in FIG. 2 the control unit 515 comprises, as principal components, a MPU 603, a ROM 602, a RAM 604 and an I/O LSI circuit device 601 including an A/D converter. The control unit 515 receives the output signals of sensors for sensing values representing the operating condition of the engine 507, carries out predetermined data processing operations, provides control signals determined by the data processing operations gives the control signals to the fuel injector 509 and the ignition coil 522 for fuel supply control and ignition timing control.

Figure 3:
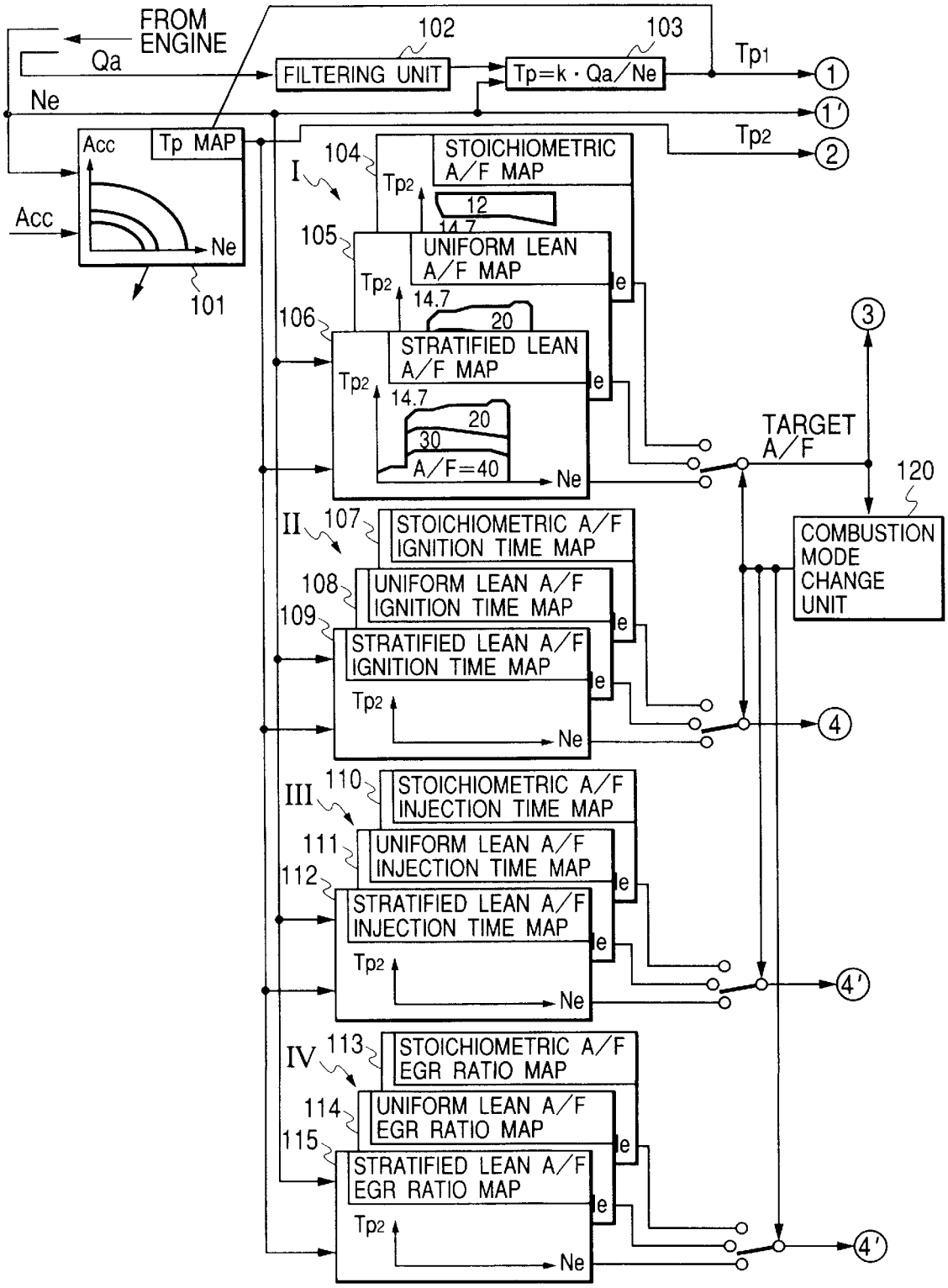
FIG. 3 is a block diagram of assistance in explaining the control operation of a front stage of the cylinder fuel injection engine controller shown in FIG. 1.
Figure 4:
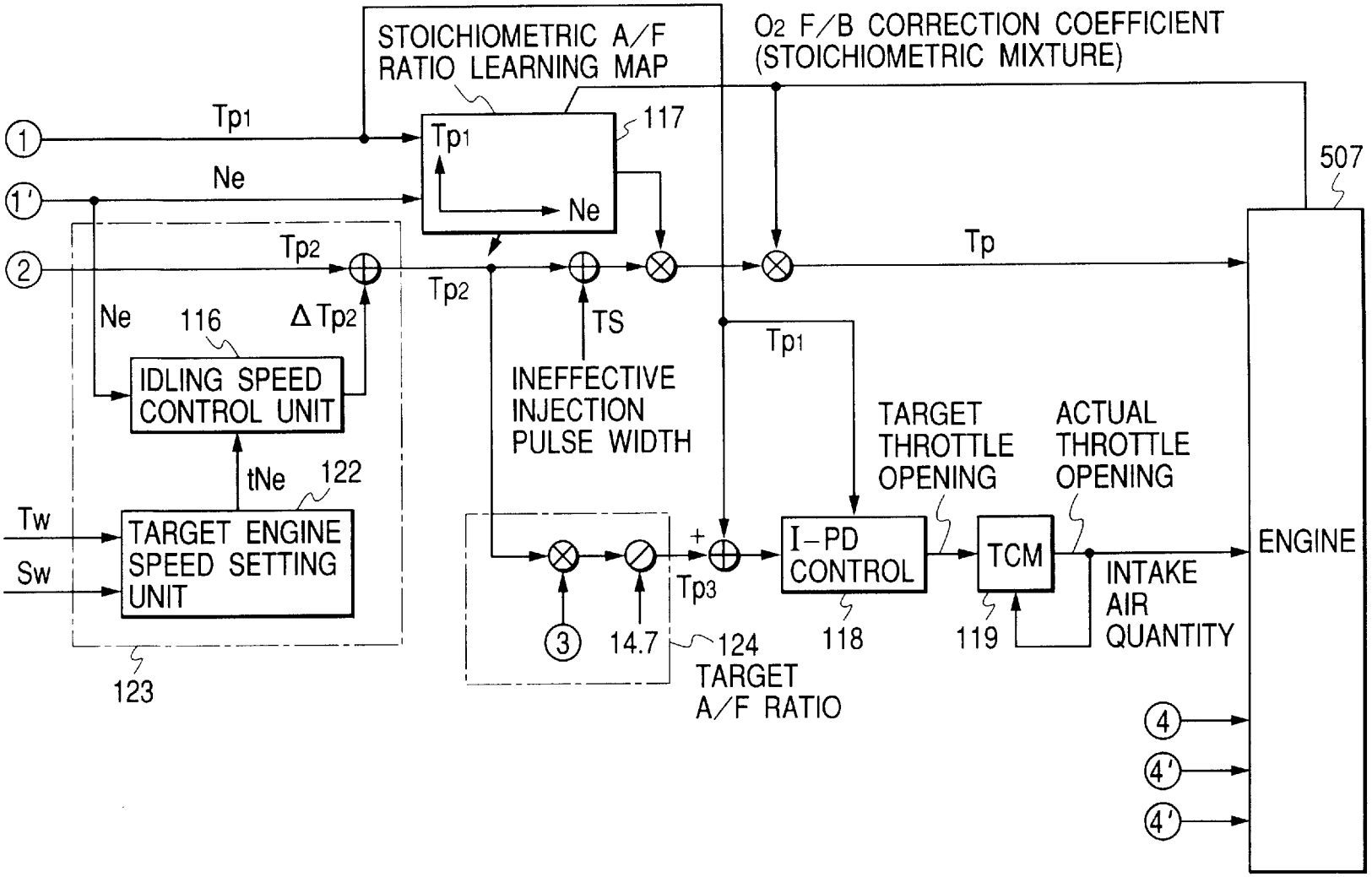
FIG. 4 is a block diagram of assistance in explaining the control operation of a back stage of the cylinder fuel injection engine controller shown in FIG. 1.

FIGS. 3 and 4 are block diagrams of assistance in explaining the control operation of the control unit 515 to control the cylinder fuel injection engine 507

An intake air quantity signal indicating an intake air quantity Qa measured by the air flow sensor 503 is filtered by a filtering device 102, the filtered intake air quantity signal is given to a basic fuel injection quantity setting unit 103. The basic fuel injection quantity setting unit 103 divides the intake air quantity Qa by an engine speed Ne, and multiplies the quotient of the division by a coefficient k which makes A/F ratio equal to the stoichiometric A/F ratio of 14.7 to determine a basic fuel injection pulse width for each cylinder, i.e., a basic fuel injection quantity Tp1. A basic fuel injection quantity correcting unit 117 learns a correction coefficient by which the fuel injection quantity is multiplied for each operating point as a function of basic fuel injection quantity Tp1 and reference fuel injection quantity Tp2 to correct the shift of characteristics attributable to differences and changes with time in the respective characteristics of the air flow sensor 503 and the fuel injectors 509 only when a fuel mixture of the stoichiometric A/F ratio is supplied.

A reference fuel injection quantity setting unit 101 determines reference fuel injection quantity Tp2 of the same dimension as the basic fuel injection quantity Tp1, to serve as a reference value for determining target fuel injection quantity Tp3 on the basis of accelerating pedal position Acc and engine speed Ne.

The values of the map for the reference fuel injection quantity Tp2 are set so that the reference fuel injection quantity Tp2 is equal to the basic fuel injection quantity Tp1 at an operating point as a function of the accelerator pedal position Acc and the engine speed Ne while a fuel mixture of the stoichiometric A/F ratio is supplied to the engine. The map for the reference fuel injection quantity Tp2 is reloadable so that the reference fuel injection quantity Tp2 can be learned on the basis of the basic fuel injection quantity Tp1 for the stoichiometric A/F ratio according to the specific characteristics of sensors and such installed on an individual car.

In this embodiment, A/F ratio, ignition time fuel injection time and EGR ratio, which are control parameters for controlling the engine 507, are retrieved from maps by two parameters, i.e., the engine speed Ne and the reference fuel injection quantity Tp2. Since the reference fuel injection quantity Tp2 is a function of engine loads the axis for the reference fuel injection quantity Tp2 can be substituted by an axis for engine load or an axis for the accelerator pedal position Acc. The reference fuel injection quantity Tp2 is equal to the basic fuel injection quantity Tp1 when the engine is operating at the stoichiometric A/F ratio. A parameter map set for each parameter has three parameter maps; a parameter map for a stoichiometric combustion mode, a parameter map for a uniform lean combustion mode and a stratified lean combustion mode.

An A/F ratio map set (I) has a stoichiometric A/F map 104, a uniform lean A/F map 105 and a stratified lean A/F map 106. An ignition time map set (II) has a stoichiometric A/F ignition time map 107, a uniform lean A/F ignition time map 108 and a stratified lean A/F ignition time map 109. An ignition time map set (III) has a stoichiometric A/F injection time map 110, a uniform lean A/F injection time map 111 and a stratified lean A/F injection time map 112. An EGR ratio map set (IV) has a stoichiometric A/F EGR ratio map 113, a uniform lean A/F EGR ratio map 114 and a stratified lean A/F EGR ratio map 115.

A combustion mode change unit 120 selects the map to be used among those of the parameters, i.e., A/F ratio, ignition time, fuel injection time and EGR ratio. A procedure to be carried out by the combustion mode change unit 120 will be described later with reference to FIG. 9.

The two elements that decide an operating A/F ratio, i.e., intake air quantity Q and fuel injection quantity Tp, are calculated on the basis of the reference fuel injection quantity Tp2. Fuel injection quantity Tp is determined by adding a reference change ΔTp2 to the reference fuel injection quantity Tp2 to obtain a reference fuel injection quantity Tp2', adding an ineffective injection pulse width Ts of the injector 509 to the reference fuel injection quantity Tp2', and correcting the sum by the basic fuel injection quantity Tp1 and multiplying the corrected value by a O2 F/B correction coefficient only for the stoichiometric A/F combustion mode.

A target fuel injection quantity Tp3 necessary to achieve a target A/F ratio is obtained by adding a reference change ΔTp2 to the reference fuel injection quantity Tp2 to obtain a reference fuel injection quantity Tp2', multiplying the reference fuel injection quantity Tp2' by a target A/F ratio of, for example, 40 by a target A/F ratio calculating unit 124, and dividing the product of the multiplication by the stoichiometric A/F ratio of 14.7. From the view point of controls the target fuel injection quantity Tp3 is not used as a target fuel injection quantity and is used as a target intake air quantity. The target fuel injection quantity Tp3 and the basic fuel injection quantity Tp1 are compared and throttle opening is controlled by a feedback control mode to control intake air quantity by making the basic fuel injection quantity Tp1 vary according to the target fuel injection quantity Tp3 so that a desired A/F ratio can be achieved.

An I-PD control unit 118 compares the target fuel injection quantity Tp3 and the basic fuel injection quantity Tp1 and determines a target throttle opening on the basis of the difference between the target fuel injection quantity Tp3 and the basic fuel injection quantity Tp1. A TCM (throttle control module) 119 control throttle opening according to a target throttle opening given thereto.

Description will be made of a reference fuel injection quantity control unit 123 shown in FIG. 4 for controlling the reference fuel injection quantity Tp2, having a target engine speed setting unit 122 and an idling speed control unit 116.

Figure 5:
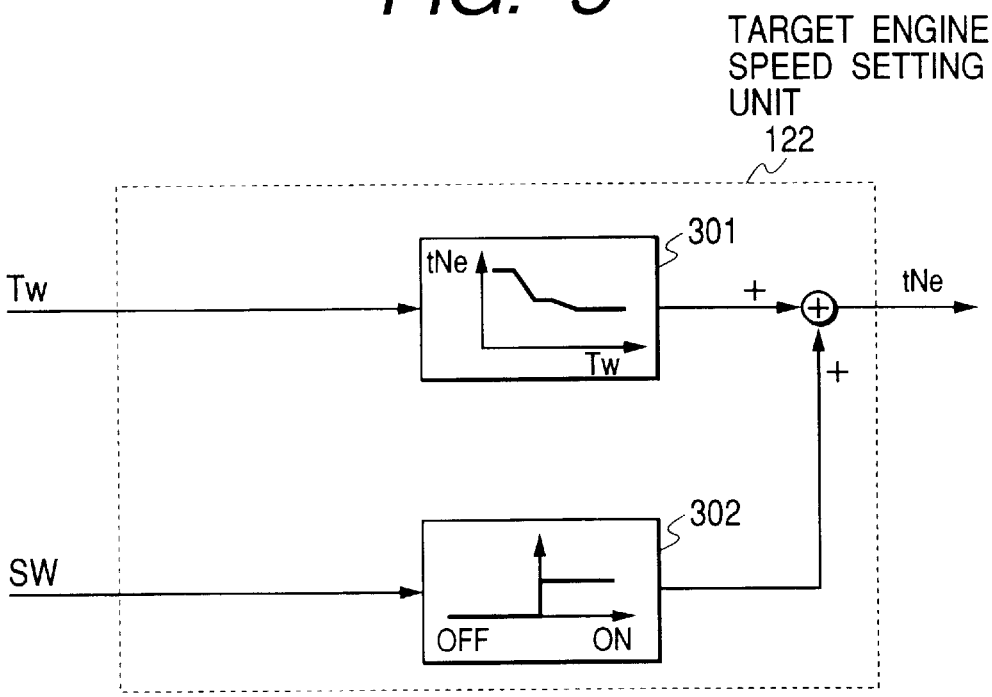
FIG. 5 is a block diagram of a target engine speed setting unit included in the cylinder fuel injection engine controller shown in FIG. 1.

Referring to FIG. 4 an input signal representing a target engine speed tNe to be given to the idling speed control unit 116 is calculated by the target engine speed setting unit 122 shown in FIG. 5. The target engine speed setting unit 122 finds a basic idling speed corresponding to a cooling water temperature Tw in a table 301, determines an incremental engine speed corresponding to the condition of the load switch from a block 302, adds the incremental engine speed to the basic idling speed to set a target engine speed Ne. The incremental engine speed is, for example, 100 rpm by which the engine speed is raised to stabilize the engine speed when an air conditioning system is turned on.

Figure 6:
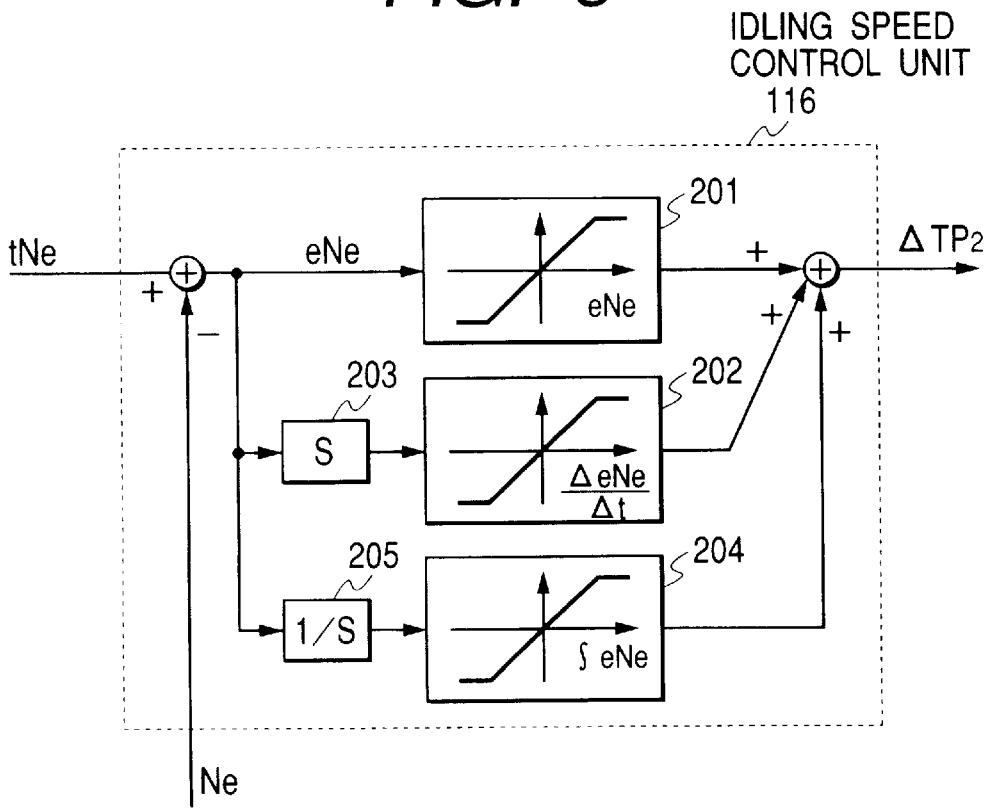
FIG. 6 is a block diagram of an idling speed control unit included in the cylinder fuel injection engine controller shown in FIG. 1.

As shown in FIG. 6, the idling speed control unit 116 calculates the deviation eNe of the actual engine speed Ne from the target engine speed tNe, and executes a PID control operation on the basis of the proportional, differential and integral variations of the deviation eNe, provides a reference change ΔTp2 in the reference fuel injection quantity Tp2 to adjust the reference fuel injection quantity Tp2'. The proportional variation of the deviation eNe is multiplied by a gain provided by a block 201, the result of differentiation of the deviation by a differentiator 203 is multiplied by a derivative gain by a block 202, and the result of integration of the deviation by an integrator 205 is multiplied by an integral gain by a block 204. Three components are added to obtain the reference change ΔTp2 for the reference fuel injection quantity Tp2.

Figure 7:
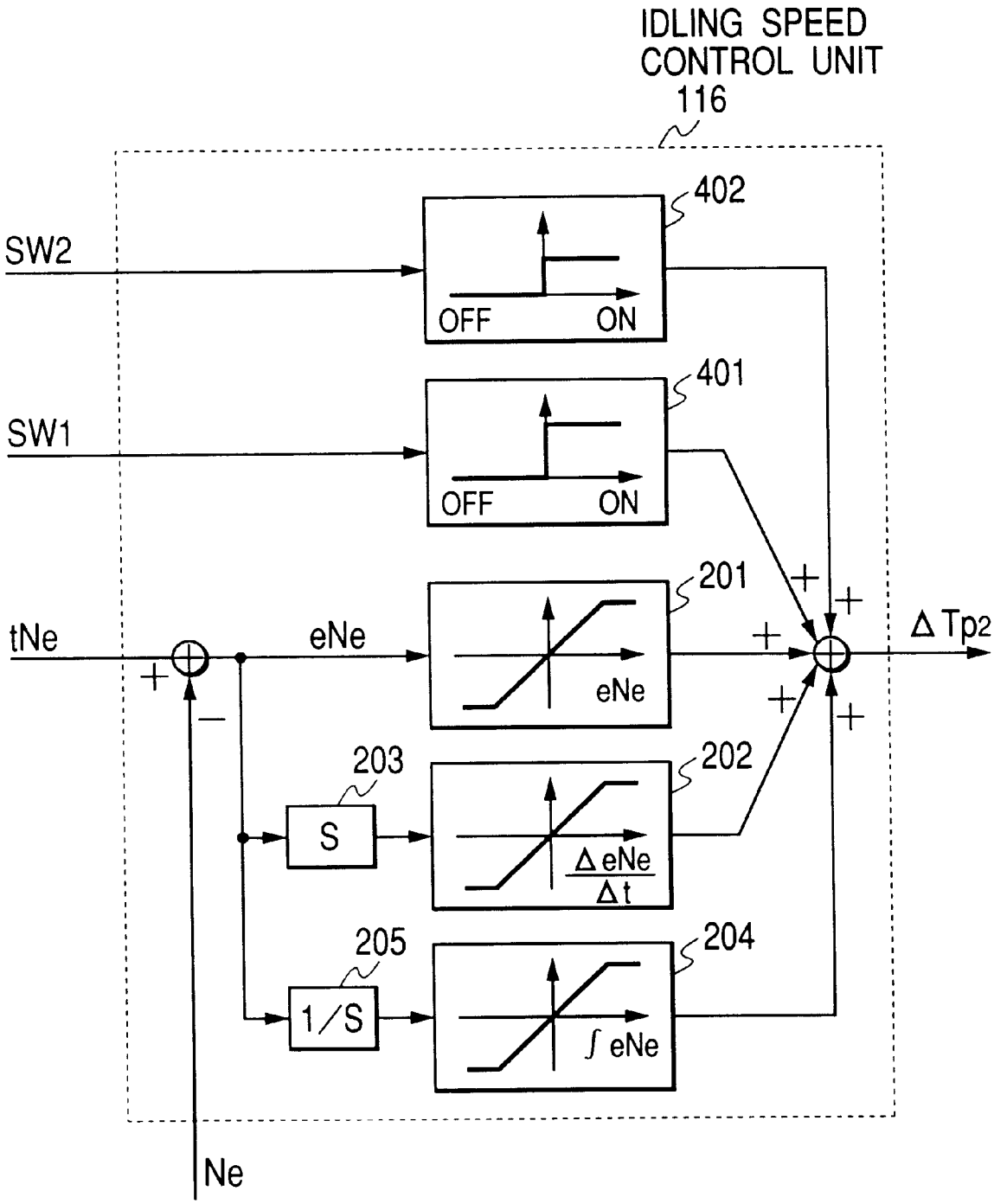
FIG. 7 is a block diagram of another idling speed control unit to be employed in the cylinder fuel injection engine controller shown in FIG. 1.

Fuel supply rate and air intake rate must be increased not only for increasing engine speed but also to increase the torque generated by the engine to maintain the existing engine speed when the load on the engine is increased. Therefore an idling speed control unit 116 shown in FIG. 7 is necessary to correct the idling speed when the load on the engine is changed. The idling speed control unit 116 of FIG. 7 comprises, in addition to the components of the idling speed control unit 116 of FIG. 6 blocks 401 and 402 which increases the reference fuel injection quantity Tp2' when the load switch SW is closed. Increments for the reference change ΔTp2 for changing the reference fuel injection quantity Tp2 are set according to the magnitudes of load for the blocks 401 and 402.

Figure 8:
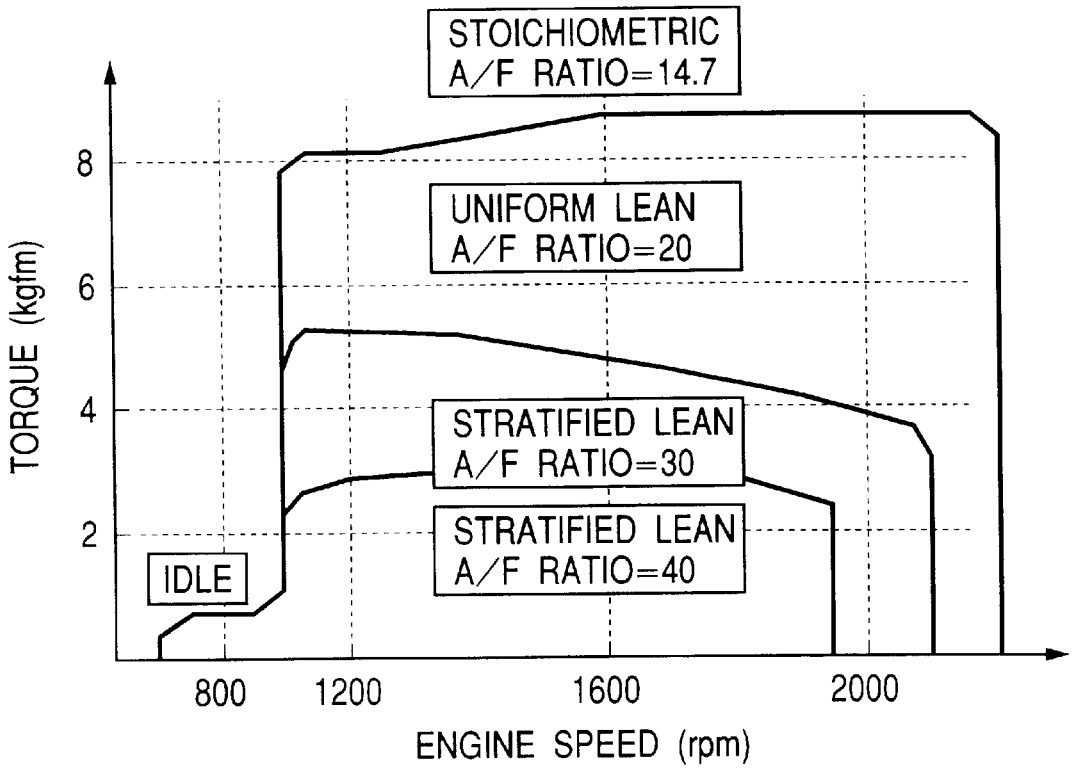
FIG. 8 is a graph of assistance in explaining an A/F ratio setting operation of the cylinder fuel injection engine controller shown in FIG. 1.

FIG. 8 shows the A/F ratio map set (I) for setting an A/F ratio for the cylinder fuel injection engine 507. The stoichiometric A/F map, the uniform lean A/F map and the stratified lean A/F map shown in FIG. 3 are developed on the basis of the A/F ratio map set (I). The A/F ratio=40 for an idling speed range. The map set shown in FIG. 8 applies to a condition where the engine is warmed up. Since stable stratified lean combustion cannot be carried out while the engine is cold, stoichiometric combustion is performed and parameters are retrieved from the maps by the map for stoichiometric combustion.

The combustion mode change unit 120 shown in FIG. 4. A procedure to be carried out by the combustion mode change unit 120 will be described hereinafter with reference to FIG. 9.

Figure 9:
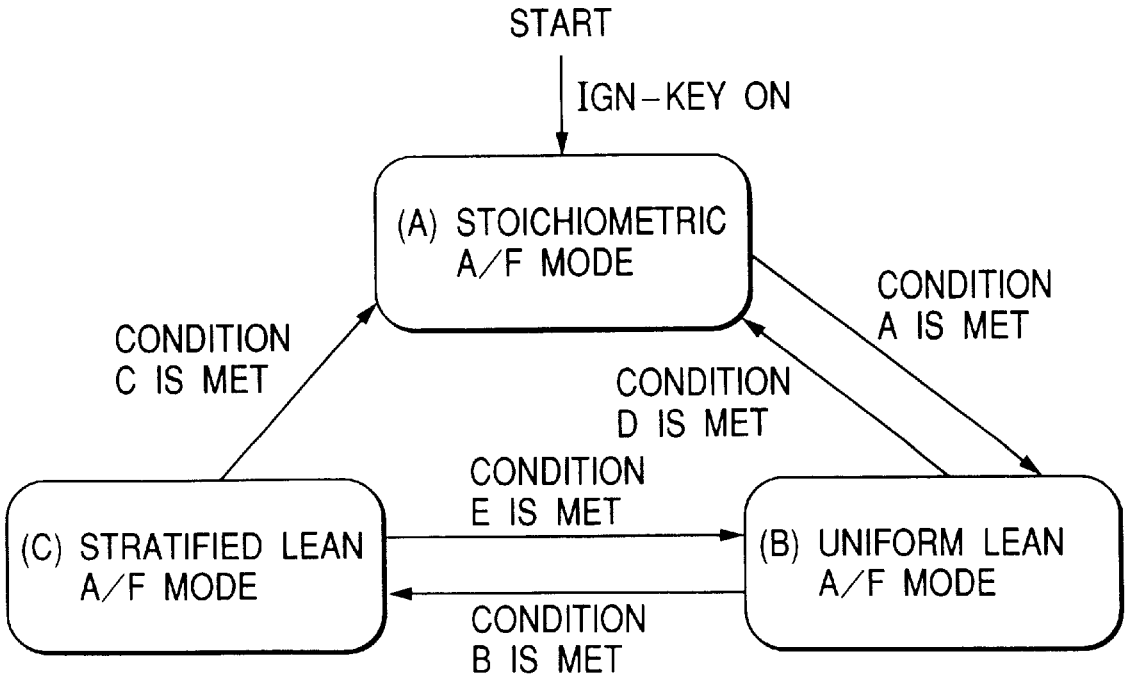
FIG. 9 is a diagram of assistance in explaining the transition of a mode controlled by a combustion mode change unit included in the cylinder fuel injection engine controller shown in FIG. 1.

FIG. 9 is a diagram of assistance in explaining the transition of a mode controlled by the combustion mode change unit 120. The stoichiometric combustion mode (A) is selected at the start of the engine 507. Condition A must be met for transition from the stoichiometric combustion mode (A) to a uniform lean combustion mode (B). If condition B is met during operation in the uniform lean combustion mode (B), the combustion mode changes to a stratified lean combustion mode (C). If condition C is met during operation in the stratified lean combustion mode (C), the combustion mode changes to the stoichiometric combustion mode (A). If condition E is met during operation in the stratified lean combustion mode (C), the combustion mode changes to the uniform lean combustion mode (B). If condition D is met during operation in the uniform lean combustion mode (B), the combustion mode changes to the stoichiometric combustion mode (A).

Condition A: All conditions A1, A2 and A3 are met.

A1: Target A/F ratio retrieved from the stoichiometric A/F ratio map meets an inequality: (Target A/F ratio)≧20.

A2: (Cooling water temperature TWN)≧40° C.

A3: (Increasing coefficient after start)=0

Condition B: Target A/F ratio retrieved from the uniform lean A/F ratio map meets an inequality: (Target A/F ratio) ≧30.

Condition C: Fuel cut condition for deceleration is met.

Condition D: Target A/F ratio retrieved from the uniform lean A/F ratio map meets an inequality: (Target A/F ratio) ≦19.

Condition E: Target A/F ratio retrieved from the stratified lean A/F ratio map meets an inequality: (Target A/F ratio) ≦28.

As mentioned above, when the combustion mode is decided by the combustion mode change unit 120 shown in FIG. 9, an ignition time, a fuel injection time and an EGR ratio are retrieved from the corresponding maps.

Figure 10:
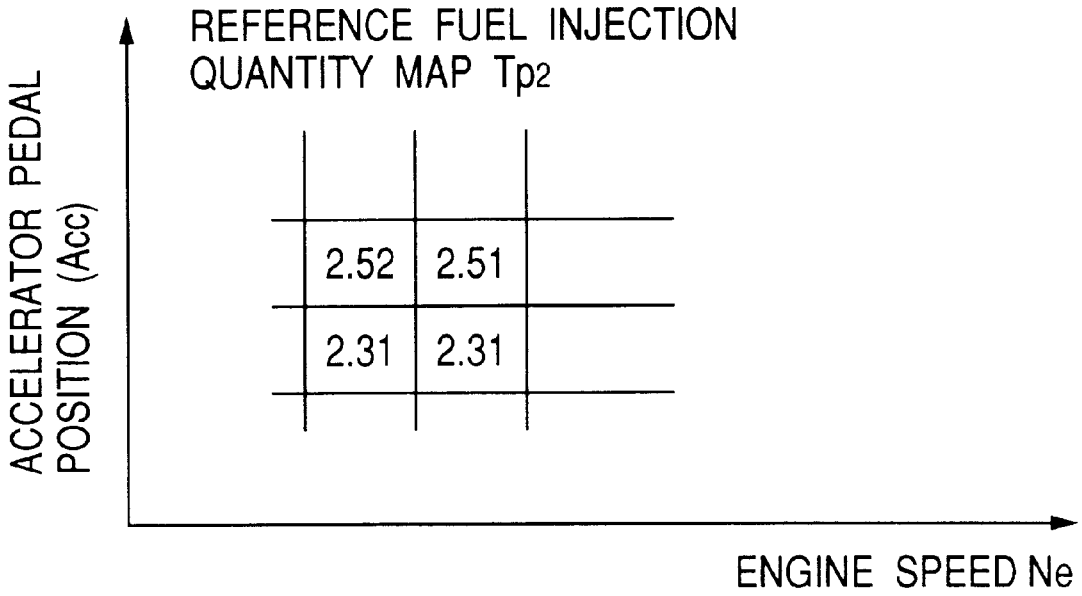
FIG. 10 is diagram showing, by way of example, a reference map to be used by a reference fuel injection quantity setting unit included in the cylinder fuel injection engine controller shown in FIG. 1.

FIG. 10 shows, by way of example, a map to be used by the reference fuel injection quantity setting unit 101 shown in FIG. 3 for determining the reference fuel injection quantity Tp2. The reference fuel injection quantity Tp2 is retrieved from the map by engine speed Ne and accelerator pedal position Acc.

Figure 11:
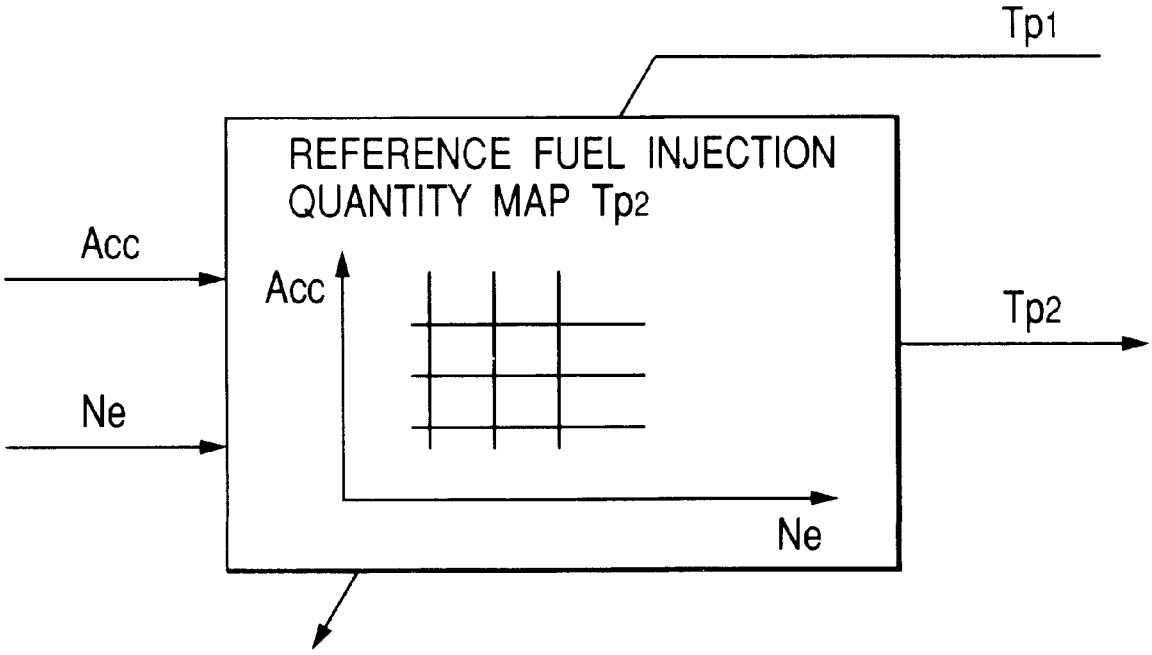
FIG. 11 is a block diagram of assistance in explaining the control operation of the reference fuel injection quantity setting unit included in the cylinder fuel injection engine controller shown in FIG. 1.

Set values for the reference fuel injection quantity Tp2 included in the reference fuel injection quantity map are set so that the reference fuel injection quantity Tp2 for the stoichiometric combustion mode is equal to the basic fuel injection quantity Tp1. However, as shown in FIG. 11, the map for the reference fuel injection quantity Tp2 is reloadable to enable learning the reference fuel injection quantity Tp2 on the basis of the basic fuel injection quantity Tp1 for the stoichiometric combustion mode according to the characteristics of the sensors employed in the car.

Figures 12, 13:
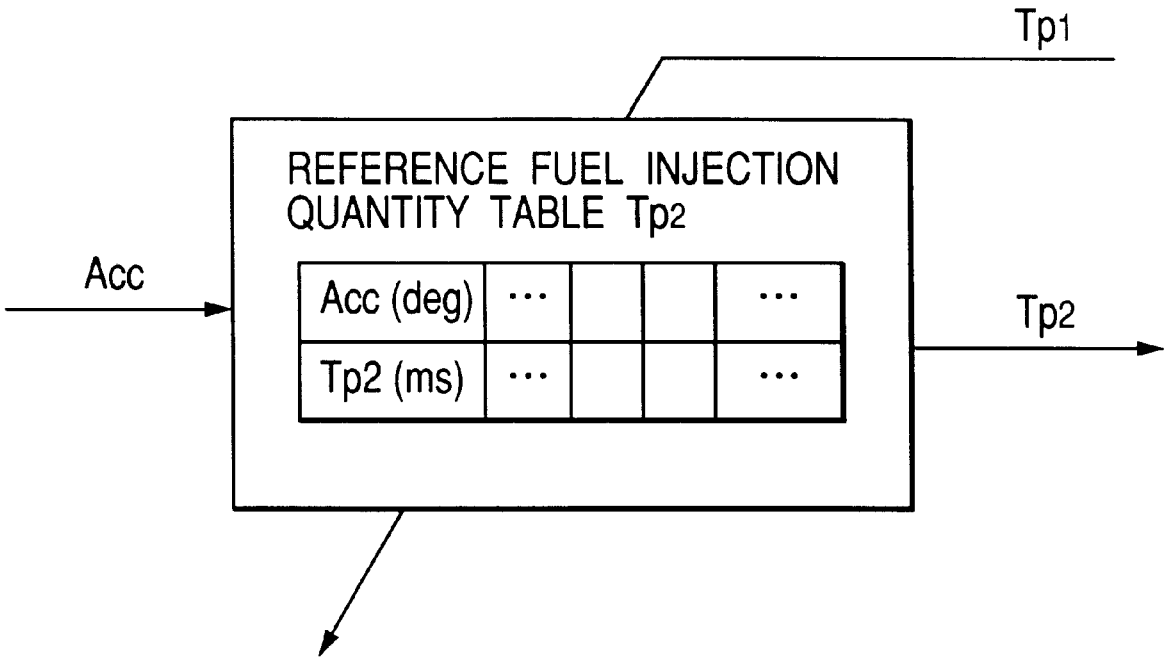
FIG. 12 is a diagram showing, by way of example, a reference table to be used by the reference fuel injection quantity setting unit included in the cylinder fuel injection engine controller shown in FIG. 1.
FIG. 13 is a block diagram of assistance in explaining the control operation of the reference fuel injection quantity setting unit included in the cylinder fuel injection engine controller shown in FIG. 1.

FIG. 12 is a reference fuel injection quantity table tabulating reference fuel injection quantities for accelerator pedal positions. The set values of the reference fuel injection quantity Tp2 shown in the reference fuel injection quantity table are determined so that the reference fuel injection quantity Tp2 in the stoichiometric combustion mode is equal to the basic fuel injection quantity Tp1. However, the table of the reference fuel injection quantity Tp2 is reloadable to enable learning the reference fuel injection quantity Tp2 on the basis of the basic fuel injection quantity Tp1 for the stoichiometric combustion mode according to the characteristics of the sensors employed in the car.

Figure 14:
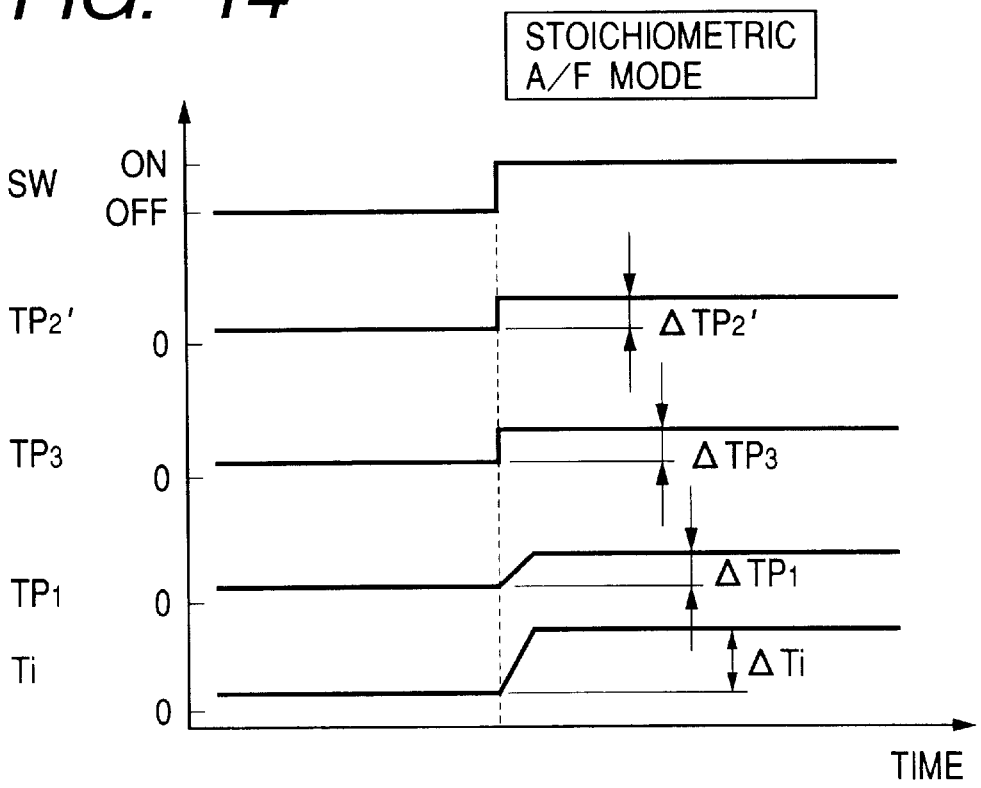
FIG. 14 is a time chart showing the variations of controlled variables controlled by the cylinder fuel injection engine controller shown in FIG. 1 in an operating mode using a stoichiometric fuel mixture.

FIG. 14 is a time chart showing the variations of controlled variables controlled by the cylinder fuel injection engine controller when the load switch SW is closed during operation in the stoichiometric combustion mode. When the load switch SW is closed, the block 402 shown in FIG. 7 increases the reference fuel injection quantity Tp2', and the target fuel injection quantity Tp3 is increased accordingly. That is, in FIG. 14, a change ΔTp2' for the reference fuel injection quantity Tp2' is equal to a change ΔTp3 for the target fuel injection quantity Tp3. When the reference fuel injection quantity Tp2' is increased, the injection pulse width Ti is increased to increase the quantity of the fuel injected for one combustion cycle. At the same time, when the target fuel injection quantity Tp3 is increased, the basic fuel injection quantity Tp1 and the intake air quantity Q are increased through the feedback control of the throttle.

Figure 15:
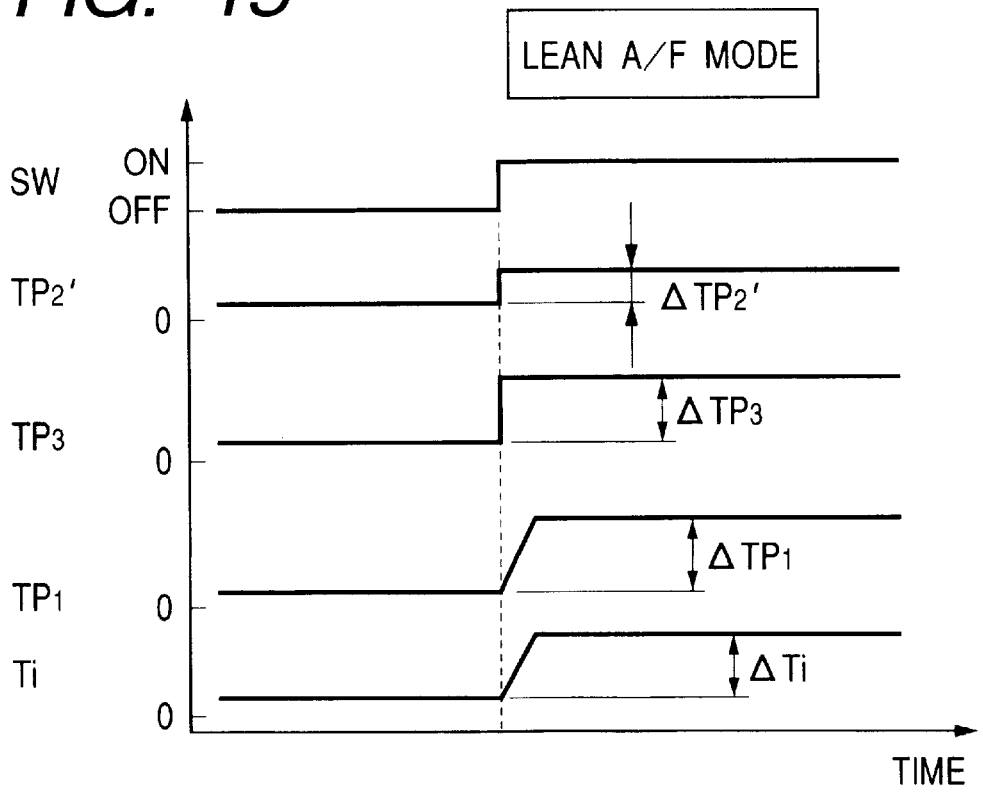
FIG. 15 is a time chart showing the variation of controlled variables controlled by the cylinder fuel injection engine controller shown in FIG. 1 in an operating mode using a lean fuel mixture.

FIG. 15 is a time chart showing the variation of controlled variables controlled by the cylinder fuel injection engine controller in the stratified lean combustion mode or the uniform lean combustion mode.

As shown in FIG. 15, the block 402 shown in FIG. 7 increases the reference fuel injection quantity Tp2 when the load switch SW is closed. Consequently, the injection pulse width Ti is increased to increase the quantity of the fuel injected for one combustion cycle, which is similar to the operation for increasing the quantity of the fuel injected for one combustion cycle in the stoichiometric combustion mode. However, in the lean combustion mode, the reference fuel injection quantity Tp2' is multiplied by the target A/F ratio of, for example, 40, and then the product is divided by the stoichiometric A/F ratio of 14.7 to calculate the target fuel injection quantity Tp3. Therefore, the target fuel injection quantity Tp3 is greater than that for the stoichiometric combustion mode. A change ΔTp3 for the target fuel injection quantity Tp3 shown in FIG. 15 is equal to the product of multiplication of the change ΔTp3 for the target fuel injection quantity Tp3 in FIG. 14 by the ratio between the A/F ratios. The target fuel injection quantity Tp3 is increased and the throttle opening is increased accordingly by feedback control to increase intake air quantity by increasing the basic fuel injection quantity Tp1 accordingly.

Figure 16:
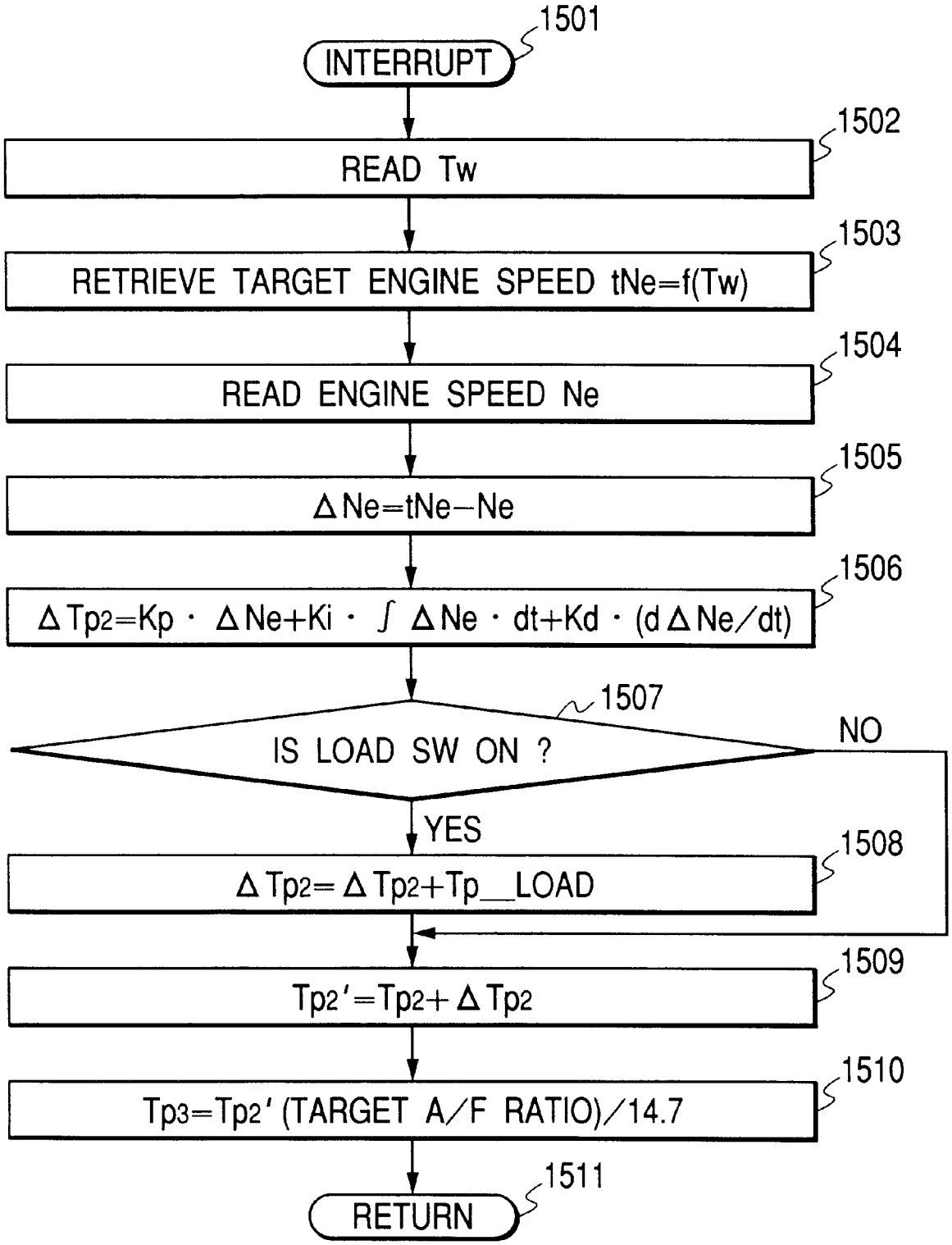
FIG. 16 is flow chart of a control procedure to be carried out by the cylinder fuel injection engine controller shown in FIG. 1.

FIG. 16 is a flow chart of a procedure to be carried out by the target engine speed setting unit 122 shown in FIG. 5 and the idling speed control unit 116 shown in FIG. 6.

Interruption is made in step 1501 to start the procedure periodically. For example, the procedure shown in FIG. 16 is started every 10 ms. In step 1502, cooling water temperature Tw is read, and a target engine speed tNe is retrieved from a cooling water temperature table in step 1503. Engine speed Ne is read in step 1504, and the deviation ΔNe of the engine speed Ne from the target engine speed tNe is calculated in step 1505. In step 1506, the proportional part, the integral part and the derivative part of the deviation ΔNe are multiplied by gain for PID control which uses the sum of the products as a reference change ΔTp2 for the reference fuel injection quantity Tp2.

In step 1507 a query is made to see whether or not the load switch SW is closed. If the load switch SW is closed, step 1508 is executed to add Tp#Load corresponding to a load to the reference change ΔTp2 for the reference fuel injection quantity Tp2, and then step 1509 is executed. If the response in step 1507 is negative, the procedure jumps from step 1507 to step 1509. In step 1509, the reference change ΔTp2 is added to the reference fuel injection quantity Tp2 to obtain the reference fuel injection quantity Tp2'. In step 1510, the reference fuel injection quantity Tp2' is multiplied by the target A/F ratio, and the product is divided by the stoichiometric A/F ratio of 14.7 to calculate the target fuel injection quantity Tp3, and then the procedure returns in step 1511.

Figure 17:
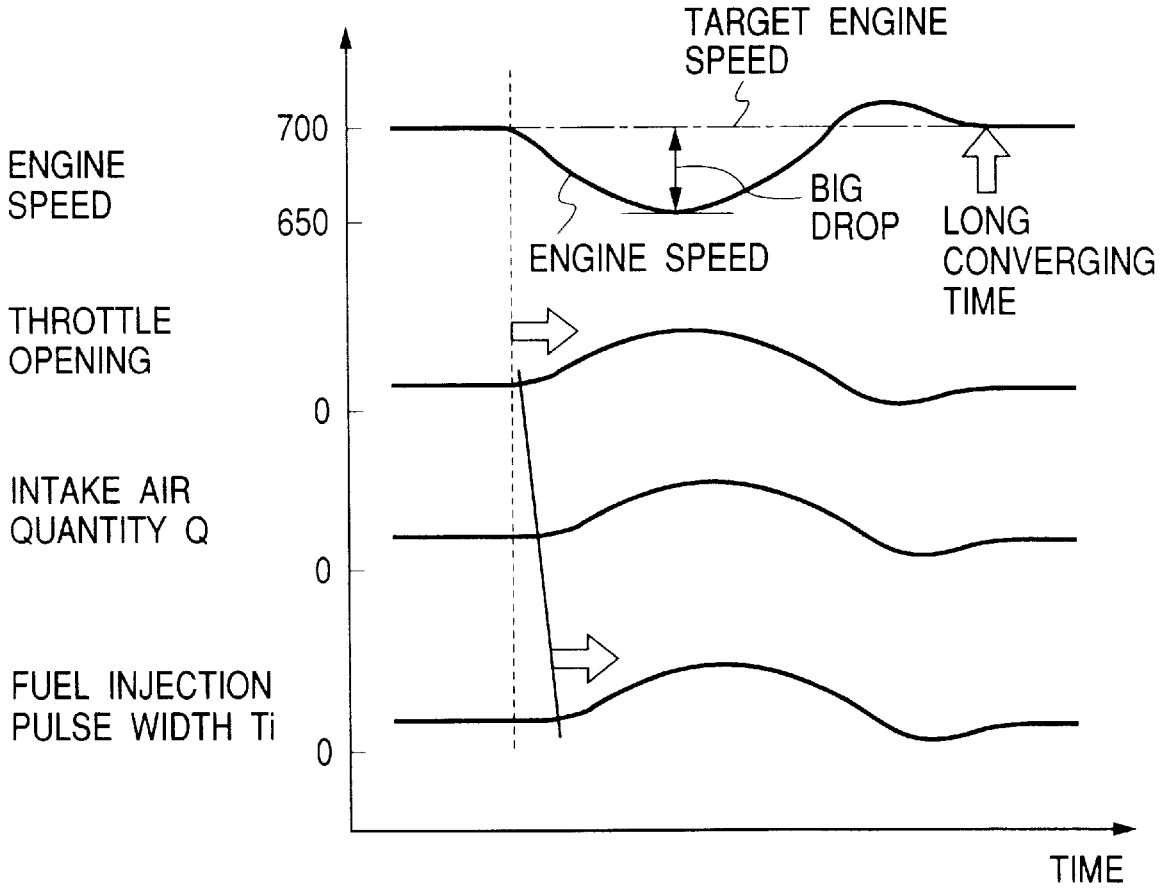
FIG. 17 is a time chart of assistance in explaining the control operation of a conventional engine controller.
Figure 18:
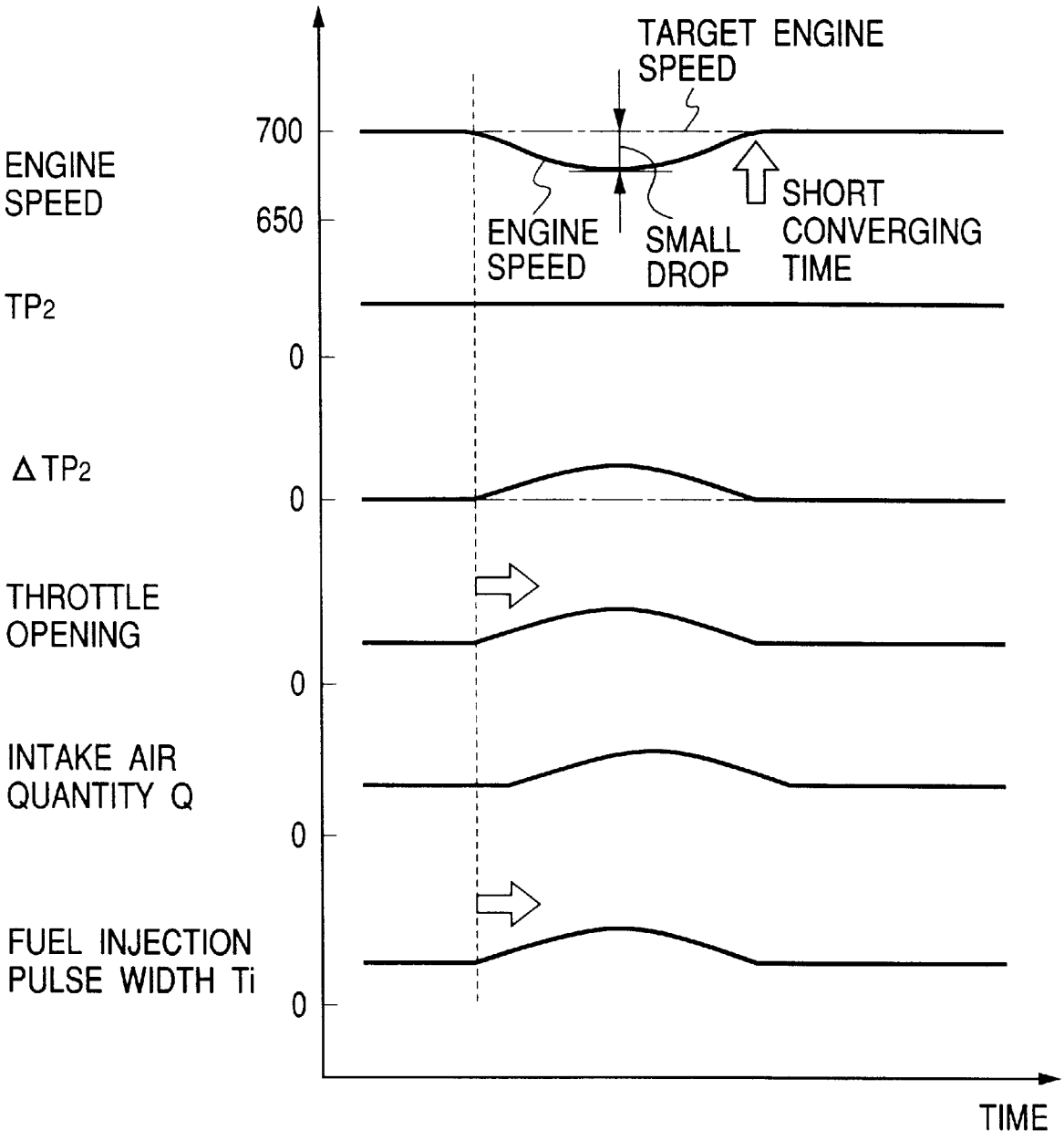
FIG. 18 is a time chart of assistance in explaining the control operation of the cylinder fuel injection engine controller shown in FIG. 1.

FIG. 17 shows the variation of the parameters when the idling speed is controlled by a conventional engine controller, and FIG. 18 shows the variation of the parameters when the idling speed is controlled by the cylinder fuel injection engine controller of the present invention.

Referring to FIG. 17, if the engine speed drops below the target engine speed, the opening of the throttle is increased to increase the intake air quantity Q. Consequently, the fuel injection pulse width Ti increases to increase the engine speed.

In the control of the engine by the cylinder fuel injection engine controller of the present invention shown in FIG. 18, the reference change ΔTp2 for the reference fuel injection quantity Tp2 increased if the engine speed drops below the target engine speed. Consequently, the fuel injection pulse width Ti and the opening of the throttle increase simultaneously, so that the engine speed starts increasing quickly. Thus, the cylinder fuel injection engine controller of the present invention is able to limit the reduction of the engine speed to an extent less than that to which the prior art controller is able to limit the reduction of the engine speed. Since the cylinder fuel injection engine controller of the present invention operates at a high response speed, the variation of the engine speed can be settled in a relatively short time.

Figure 19:
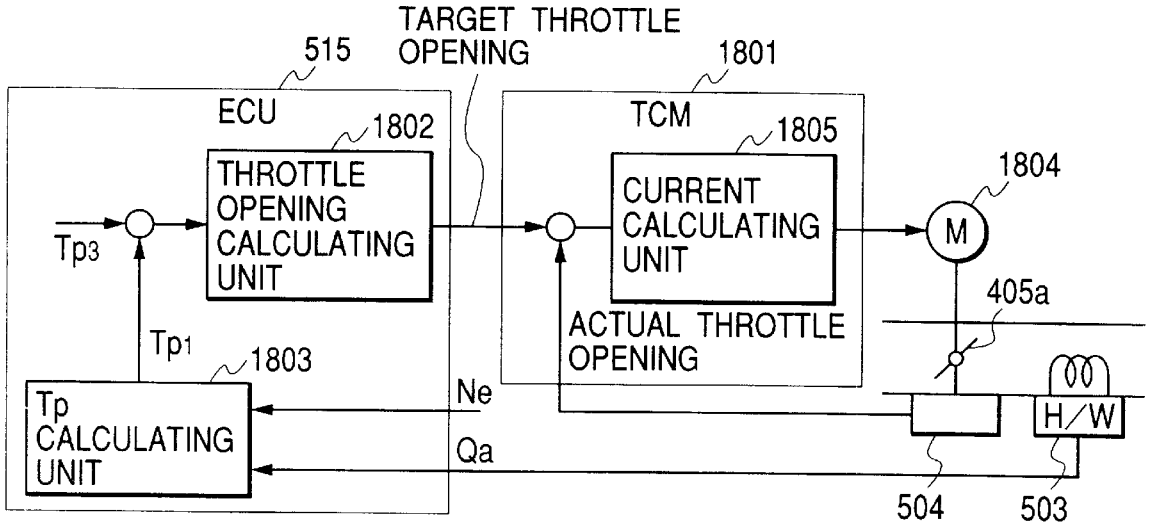
FIG. 19 is block diagram of an example of a hardware configuration of the cylinder fuel injection engine controller shown in FIG. 1.
Figure 20:
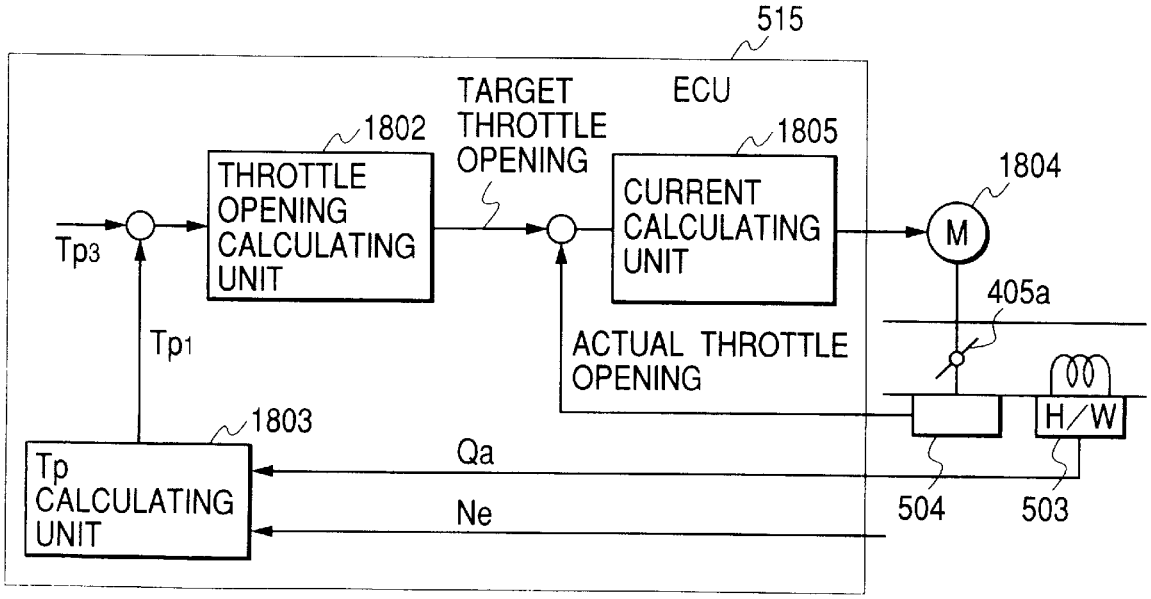
FIG. 20 is a block diagram of another example of a hardware configuration of the cylinder fuel injection engine controller shown in FIG. 1.
Figure 21:
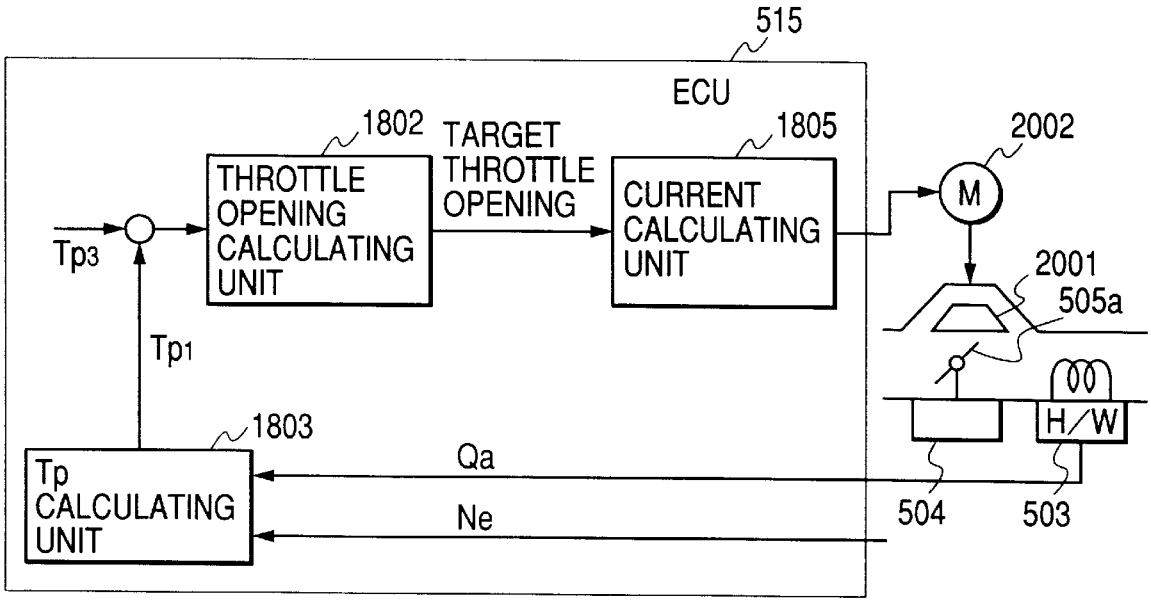
FIG. 21 is a block diagram of a third example of a hardware configuration of the cylinder fuel injection engine controller shown in FIG. 1.

FIGS. 19, 20 and 21 show hardware configurations of control systems including the cylinder fuel injection engine controller of the present invention.

In the control system shown in FIG. 19, the engine control unit 515 and the TCM (throttle control module) 1801 are separate units. The engine control unit 515 gives a target throttle opening signal indicating a target throttle opening to the TCM 1801. In the engine control unit 515, a Tp calculating unit 1803 calculates the basic fuel injection quantity Tp1 on the basis of the intake air quantity Qa and the engine speed Ne, the difference between the basic fuel injection quantity Tp1 and the target fuel injection quantity Tp3 is calculated and a throttle opening calculating unit 1802 calculates a target throttle opening.

In the TCM 1801 a current calculating unit 1805 calculates a control current for controlling a motor 1804 on the basis of the deviation of an actual throttle opening represented by a throttle opening signal provided by the throttle sensor 504 from the target throttle opening and the throttle is controlled in a feedback control mode so that the actual throttle opening coincides with the target throttle opening.

In the control system shown in FIG. 20, the engine control unit 515 and the TCM 1801 are combined in a single unit. The functions of the control system shown in FIG. 20 are the same as those of the control system shown in FIG. 19.

The control system shown in FIG. 21 employs a throttle valve 505*a* which is not an electrically controlled throttle valve. A bypass passage 2001 is formed so as to bypass the throttle valve 505*a*, and an auxiliary valve 2002 is disposed in the bypass passage 2001. The auxiliary valve 2002 is controlled to make the basic fuel injection quantity Tp1 coincide with the target fuel injection quantity Tp3.

Figure 22:
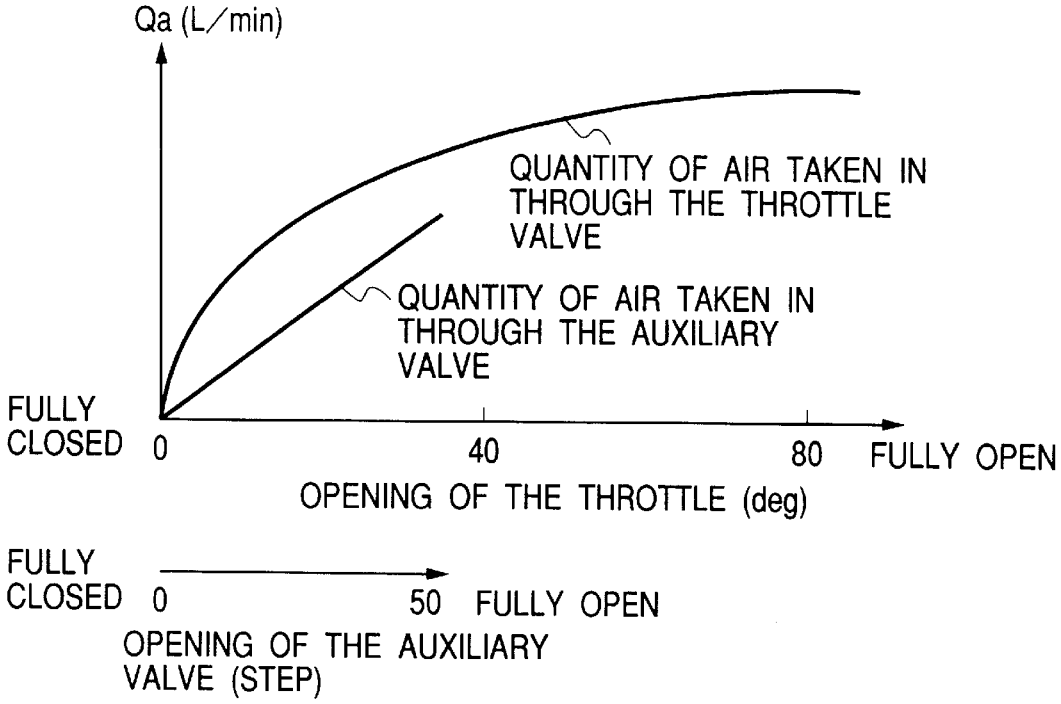
FIG. 22 is a graph showing the flow characteristics of a throttle and an auxiliary valve included in the hardware configuration of the cylinder fuel injection engine controller shown in FIG. 21.

FIG. 22 shows a control range of the auxiliary valve 2002 included in the control system shown in FIG. 21. FIG. 22 shows the relation between the flow rate of air flowing through the auxiliary valve 2002 and that of air flowing through the throttle valve 505*a*.

Although the preferred embodiment of the invention has been described the present invention is not limited thereto in its practical application, and many changes and variations may are possible therein without departing from the scope and spirit of the invention as set forth in appended claims.

As is apparent from the foregoing description, the cylinder fuel injection engine controller of the present invention has means for simultaneously changing the fuel injection quantity and the intake air quantity by changing the reference fuel injection quantity during idling operation even if the engine is operating in a stoichiometric combustion mode or a lean combustion mode. Therefore, the cylinder fuel injection engine controller is capable of controlling the engine speed at a high response speed and of stabilizing the engine speed regardless of the variation of load on the engine.

What is claimed is:

1. A cylinder fuel injection engine controller for controlling the operation of a cylinder fuel injection engine, comprising:

an intake air quantity measuring means for measuring the quantity of air taken into a cylinder of the cylinder fuel injection engine;

a basic fuel injection quantity determining means for determining a basic fuel injection quantity (Tp1) for each cylinder by dividing an intake air quantity by a measured engine speed and multiplying the quotient of the division by a coefficient which makes an A/F ratio equal to the stoichiometric A/F ratio of 14.7;

a reference fuel injection quantity determining means for determining a reference fuel injection quantity (Tp2) from the measured engine speed and a measured accelerator pedal position; and a target fuel injection quantity calculating means for determining a target fuel injection quantity (Tp3) by multiplying the reference fuel injection quantity (Tp2) by a desired A/F ratio and dividing the product of the multiplication by the stoichiometric A/F ratio of 14.7;

a reference fuel injection quantity adjusting means for adjusting the reference fuel injection quantity (Tp2) for at least one of engine speed control and load correction during idling operation.

2. The cylinder fuel injection engine controller according to claim 1, wherein fuel injection quantity (Tp) to be injected into the cylinder of the cylinder fuel injection engine and intake air quantity (Q) are controlled separately and simultaneously.

3. The cylinder fuel injection engine controller according to claim 1 further comprising an intake air quantity feedback control means for varying the basic fuel injection quantity (Tp1) according to the target fuel injection quantity (Tp3); and a control parameter retrieving means for determining an optimum ignition time, an optimum A/F ratio, an optimum fuel injection time and an optimum EGR ratio from maps by engine speed and engine load.

4. The cylinder fuel injection engine controller according to claim 1, wherein the reference fuel injection quantity determining means uses a map for calculating the reference fuel injection quantity (Tp2).

5. The cylinder fuel injection engine controller according to claim 4, wherein the reference fuel injection quantity determining means has a learning means for updating the map so that the reference fuel injection quantity (Tp2) in an operation region determined by the measured engine speed and the measured accelerator pedal position during operation in a stoichiometric combustion mode coincides with the basic fuel injection quantity (Tp1).

6. The cylinder fuel injection engine controller according to claim 5, wherein the learning means for updating the map updates the map when the temperature of the engine cooling water is not lower than a predetermined temperature, the A/F ratio is equal to the stoichiometric A/F ratio and a feedback control operation is being performed.

7. The cylinder fuel injection engine controller according to claim 1, wherein the reference fuel injection quantity determining means uses a retrieval table for calculating the reference fuel injection quantity (Tp2).

8. The cylinder fuel injection engine controller according to claim 7, wherein the reference fuel injection quantity determining means has a table updating means for coinciding the reference fuel injection quantity (Tp2) in a load region determined by the accelerator pedal position in the stoichiometric combustion mode with the basic fuel injection quantity (Tp1).

9. The cylinder fuel injection engine controller according to claim 2, wherein the intake air quantity (Q) is controlled by an electronically controlled throttle valve.

10. The cylinder fuel injection engine controller according to claim 2, wherein the intake air quantity (Q) is controlled by a valve disposed in a bypass passage formed so as to by pass the air passage of a throttle valve.

11. The cylinder fuel injection engine controller according to claim 3, wherein the control parameter retrieving means is provided with map sets for determining at least one parameter including A/F ratio, ignition time, fuel injection starting time, fuel injection terminating time, EGR ratio and the strength of whirling currents in the cylinder.

12. The cylinder fuel injection engine controller according to claim 11, wherein parameters are retrieved from the control parameter maps of the map sets by engine speed and reference fuel injection quantity, and each of the map sets has maps respectively for a stoichiometric combustion mode, a uniform lean combustion mode, and a stratified lean combustion mode.

13. The cylinder fuel injection engine controller according to claim 1, wherein the reference fuel injection quantity adjusting means comprises a target engine speed setting means for setting a target engine speed on the basis of the temperature of engine cooling water and the condition of engine load switches for controlling loads on the engine, and an idling speed control means which calculates a change in the reference fuel injection quantity (Tp2) on the basis of the target engine speed and an actual engine speed.

14. The cylinder fuel injection engine controller according to claim 1, wherein the reference fuel injection quantity (Tp2) is increased if the actual engine speed is lower than the target engine speed, and the reference fuel injection quantity (Tp2) is decreased if the actual engine speed is higher than the target engine speed.

15. The cylinder fuel injection engine controller according to claim 14, wherein the reference fuel injection quantity adjusting means increases the reference fuel injection quantity (T2) by a predetermined quantity upon the detection of the closing of the engine load switch for controlling the load on the engine.

16. The cylinder fuel injection engine controller according to claim 15, wherein the engine load switches are an air conditioning system control switch for controlling an air conditioning system, a power steering system control switch for controlling a power steering system electric device control switches for controlling electric devices, and/or an electric radiator fan control switch for controlling an electric radiator fan.

17. The cylinder fuel injection engine controller according to claim 1, wherein the reference fuel injection quantity (T2) is increased by a predetermined quantity, and the target engine speed is increased by a predetermined value when one or some of the engine load control switches are closed.

* * * * *